United States Patent [19]

Harvey

[11] 3,931,971

[45] Jan. 13, 1976

[54] PROJECTILE HAVING INDENTED SURFACE AREAS

[76] Inventor: Bobbie S. Harvey, R.R. 1 on Island, Tracy, Iowa

[22] Filed: May 10, 1974

[21] Appl. No.: 468,912

[52] U.S. Cl. ..... 273/106 R; 273/146; 273/58 R; 273/128 A; 273/96 R

[51] Int. Cl.[2] ..... A63F 3/00

[58] Field of Search... 273/95 R, 106 R, 146, 105.4, 273/128 R, 128 A, 58 R, 58 B

[56] References Cited

UNITED STATES PATENTS

| | | | |
|---|---|---|---|
| 1,563,680 | 12/1925 | Zwirner | 273/146 |
| 2,187,524 | 1/1940 | Price | 273/106 R |
| 3,169,767 | 2/1965 | Bingham | 273/105.4 |
| 3,176,990 | 4/1965 | Aliff | 273/106 R |
| 3,506,267 | 4/1970 | Taillie | 273/146 |
| 3,712,622 | 1/1973 | Odier | 273/146 |

FOREIGN PATENTS OR APPLICATIONS

| | | | |
|---|---|---|---|
| 195,757 | 4/1923 | United Kingdom | 273/146 |

*Primary Examiner*—Richard C. Pinkham
*Assistant Examiner*—Marvin Siskind
*Attorney, Agent, or Firm*—Zarley, McKee, Thomte & Voorhees

[57] ABSTRACT

The amusement device of the present invention comprises a body member formed from a sphere and having six planar surfaces formed on its outer surface. Each of the planar surface is formed at the bottom of a pie-plate shaped indentation in the body member, the indentation having an annular rim around the outer margin thereof, the rim comprising a substantially flat surface. Each of the planar surfaces has raised indicia formed thereon, the raised indicia having a height which is below the annular rims so that the rims prevent the indicia from interfering with rolling of the body member on a flat surface. The surface portions of the body member between the annular rims are spherical in configuration.

6 Claims, 8 Drawing Figures

PROJECTILE HAVING INDENTED SURFACE AREAS

SUMMARY OF THE INVENTION

The present invention relates to amusement devices and particularly to amusement devices which may be thrown and rolled for participation in a plurality of games.

The invention comprises a spherical body member having six flat surfaces formed therein much in the nature of a cube, but with spherical surfaces being retained between the adjacent margins of the planar surfaces. The body member may be hollow or it may be solid, and it may be constructed of materials which vary in their resiliency from substantially hard materials to substantially resilient materials.

The planar surfaces are formed in the shape of pie-plate like indentations in the outer surfaces of the sphere. Each of these pie-plate indentations includes indicia thereon and also include annular flat rims around the upper margins thereof. This configuration of the body member enables it to roll on a flat surface in a rather erratic and unpredictable pattern unlike the patterns which are attained with cube-like dice or with spherical balls. Occasionally the body member will come to rest not on one of the flat surfaces but on one of the spherical surfaces which are between the adjacent margins of the flat surfaces.

The ball or body member may be utilized to play a plurality of games. It may be used for throwing to determine specific scores as is presently done with dice, and it can also be used for playing catch between two participants. By rotating the body member during flight it is possible to attain various aerodynamic results which cause the ball to follow different paths as it is being thrown. By varying the spin it is possible to change the path that the ball follows during flight. The unusual shape of the ball makes it difficult to catch, and a simple game that could be played with the ball would involve scoring whenever the ball is dropped and comes to rest with a particular indicia facing upwardly.

Another method for using the present invention involves the use of nets for throwing the ball back and forth between two participants. The two participants may be individuals or it is possible to play in teams with two members of a team grasping the same net and throwing the ball to two members of another team grasping a similar net. Again the scores for each team can be determined whenever the team is unable to catch the ball and it falls on the supporting surface.

Therefore, a primary object of the present invention is the provision of an amusement device which produces an unusual pattern of movement whenever it is thrown through the air or rolled on a flat surface.

A further object of the present invention is the provision of a device which includes both flat and spherical surfaces and is capable of coming to rest on either of these surfaces.

A further object of the present invention is the provision of a device which includes raised indicia on a plurality of flat surfaces, the indicia being kept free from interference with rolling of the ball on a flat surface.

A further object of the present invention is the provision of a device which is easy to grip for throwing, but is difficult to catch.

A further object of the present invention is the provision of a device which when spinning produces a plurality of unpredictable patterns while moving through the air.

A further object of the present invention is the provision of a device which includes a dimple capable of causing the ball to come to rest in a specific predetermined position when rolling on a surface, but wherein the statistical odds of the ball coming to rest in this position are relatively small.

A further object of the present invention is the provision of a device having a shape which will permit it to roll freely and come to any of a plurality of positions on a grass surface.

A further object of the present invention is the provision of a device which can be inflated and results in different rolling actions depending upon the pressure to which it is inflated.

A further object of the present invention is the provision of a device which is economical to manufacture, durable in use, and attractive in appearance.

This invention consists in the construction, arrangements and combination of the various parts of the device, whereby the objects contemplated are attained as hereinafter more fully set forth, specifically pointed out in the claims, and illustrated in the accompanying drawings in which:

Figure 2:
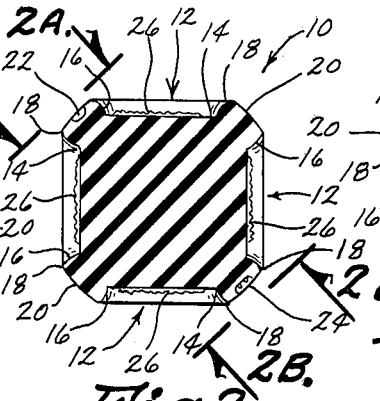
FIG. 2 is a sectional view taken along line 2—2 of FIG. 1.
Figure 2A:
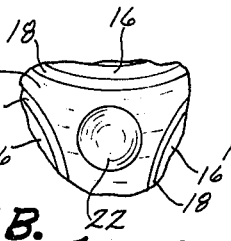
Figure 2B:
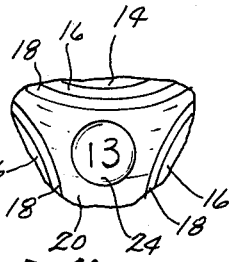

FIGS. 2*a* and 2*b* are enlarged partial sectional views taken along lines 2*a* and 2*b* respectively.

Figure 1:
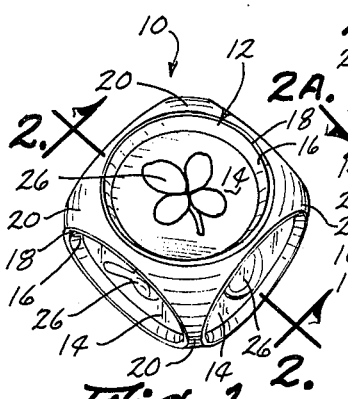
FIG. 1 is a perspective view of the body member of the present invention.
Figure 3:
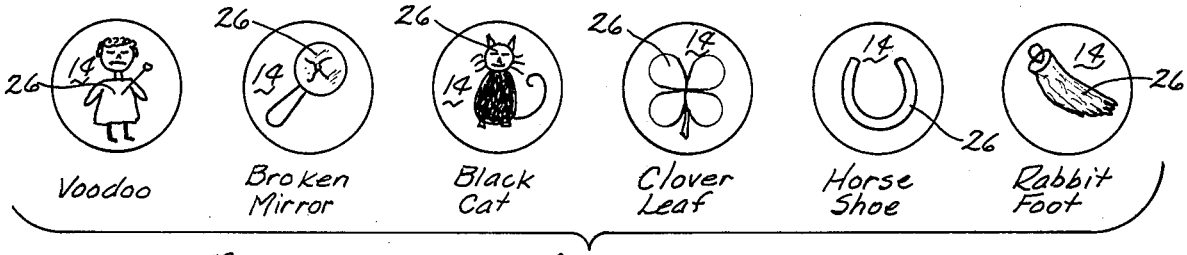

FIG. 3 is a view showing the various indicia on the six surfaces of the members shown in FIG. 1.

Figure 4:
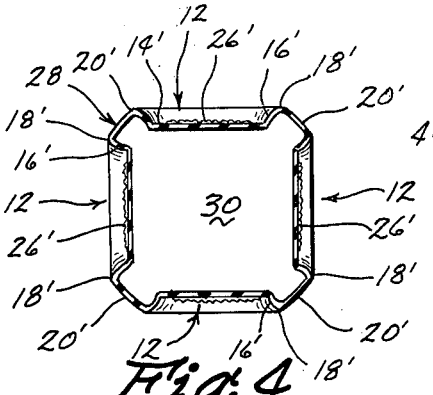

FIG. 4 is a modified form of the body members shown in FIGS. 1 and 2.

Figure 5:
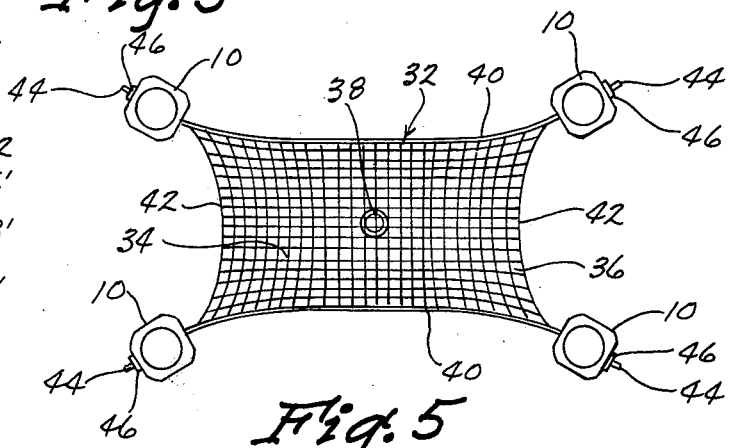

FIG. 5 is a plan view of a net device which is used in conjunction with the body members shown in FIGS. 1–4.

Figure 6:
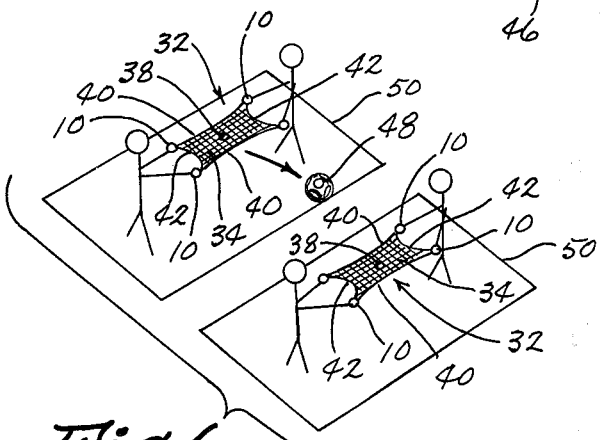

FIG. 6 is a perspective view illustrating the use of the net of FIG. 5 and the body members of FIGS. 1–4.

DETAILED DESCRIPTION

Referring to FIGS. 1–3, a body member 10 includes six pie-plate shaped indentations thereon which are referred to generally by the numeral 12. Each indentation includes a substantially flat bottom planer surface 14 and circular beveled walls 16. Extending around the circular upper margins of each indentation 12 is a flat annular rim 18 which is substantially parallel to flat bottom surface 14.

Indentations 12 deviate from the general spherical shape of body member 10, and consequently those portions 20 between the margins of annular rims 18 comprise a spherical shape. A single dimple 22 is formed in spherical portions 20, and a corresponding dimple 24 is formed diametrically opposite from dimple 22. Dimple 24 includes indicia therein such as illustrated by the indicia 13 in FIG. 2*b*. The volumes of carved out portions within dimples 22,24 are equal so that the two dimples do not affect the symmetrical balance of body member 10 with respect to the center thereof. Thus the weight of body member 10 is balanced with respect to its center.

Each planer surface 14 includes raised indicia 26 thereon. Indicia 26 extend upwardly from planer surfaces 14, but are positioned inwardly from annular rim 18 so that the indicia do not interfere with the rolling of body member 10 whenever it rolls on a flat surface. Referring to FIG. 3, six different indicia are provided on surfaces 14. They are indicated by the voodoo, broken mirror, black cat, clover leaf, horseshoe, and rabbit foot indicated in the drawings. It is also possible to use different indicia without detracting from the invention.

Referring to FIG. 4, a modified form of the present invention is designated by the numeral 28. Body member 28 is identical in outer shape to body member 10, and therefore, primed numbers have been used in FIG. 4 which correspond to the numbers used in FIGS. 1 and 2. The primary difference between body member 10 and body member 28 pertains to the fact that body member 10 is solid in construction whereas body member 28 is hollow or balloon like. Body member 10 may be constructed of a resilient material such as rubber, plastic or the like, and body member 28 may also be constructed of resilient material. However, body member 28 includes a hollow portion 30 which may contain air or other gaseous substance. The gas pressure within portion 30 may be varied to produce a ball having different characteristics.

When thrown back and forth between two participants, body members 10 and 28 produce a variety of actions depending upon the amount of spin imparted to the body member. Pie-shape indentations 12 produce various aerodynamic effects on the body member depending upon how much spin is imparted thereto. Furthermore, the body members are difficult to catch inasmuch as the participants' fingers may strike beveled surfaces 16 or other surfaces on the irregularly shaped body member so as to hinder catching the body member during flight. This difficulty is further enhanced by the resiliency of the body member which causes it to have a tendency to bounce away from the participants' hands as it is being caught.

Body members 10 and 26 also provide a very unusual action when rolling on a flat surface. Conventional cube-shaped members such as conventional dice tend to come to rest quickly when rolled on a flat hard surface. But the device of the present invention rolls in a manner which is different from that of a spherical ball and which is also different from that of a cube-shaped die. Furthermore, occasionally the device of the present invention comes to a rest on a spherical surface 20, but the chances of this happening are statistically less than the chances of coming to rest on one of indentations 12. Also, in rare circumstances, the body member comes to rest on dimple 22 or dimple 24. The particular rolling action which may be obtained can be varied by changing the resiliency of the material of which ball 10 is constructed, by changing the pressure within body member 28, by changing the dimensions of indentations 12 and consequently the dimensions of spherical surfaces 20 and also by changing the overall size of the body member.

Referring to FIGS. 5 and 6, a plurality of body members 10 are shown used in conjunction with a net 32. Net 32 includes a plurality of meshed members 34 which form mesh openings 36 therein. At the center of net 32 is a ring-like weight element 38.

Net 32 includes two heavy side cords 40 and two thin side cords 42. The opposite ends of cords 40 provide four corner cords 44. Each body member 10 includes a bore (not shown) extending diametrically therethrough, and corner cords 44 extend through said bore.

A retainer means 46 such as a knot or the like holds body member 10 against movement off the end of corner cords 44.

The size of body member 10 is considerably larger than the size of mesh openings 36 so that during storage body members 10 do not become entangled in net 32. During use, net 32 is used to toss a fifth body member similar to that shown in FIGS. 1–4 back and forth. The fifth body member is designated by the numeral 48 in FIG. 6. Each net 32 is grasped by two participants in a team. Each participant grasps the two body members 10 which are joined by thin side cords 42 so that heavy side cords 40 extend between the two team mates. The weight element 38 causes the center of each net 32 to be slightly depressed which facilitates both catching and throwing of body member 48. Each team is confined to a boundary area designated by the numeral 50. In the event that one team is unsuccessful in catching body member 48, the body member is permitted to roll on the ground until it comes to rest, at which time the indicia which is upwardly exposed is read and the game is scored accordingly. It is possible that body member 48 will come to rest on spherical surfaces 20, on dimple 22, or on dimple 24, in which case appropriate scoring values are attributed.

It has been found that spherical members for handles are safer than other shapes for this particular type of game. When two players are playing as a team, often they jerk the net out of each other's hands. The spherical balls permit the handles to be jerked freely out of the hand whereas other types of handles might not release as easily and could result in injury to the players.

The net is preferably made of braided nylon which has been found to provide the most desirable action during the throwing and catching of the body member. It has also been found that the placement of the heavier cords 40 between the two team mates results in the most desirable action during the playing of the game.

Ring element 38 in the center of the net is slightly smaller than body members 10 so that it does not interfere with the trajectory of the body members during flight.

While annular rim 18 extending around indentation 12 is small, it has been found that this particular rim provides a different action when body member 10 is rolled on a flat surface. Furthermore, this flat annular rim makes the body member somewhat more difficult to catch during flight. An important feature of the present invention is the ability of body member 10 to come to rest on one of its spherical surfaces.

The pie-shaped indentations 12 permit the raised indicia on the inner surface thereof without interfering with the rolling of the ball. Because the indicia are raised, they do not wear away as would be the case if they appeared on the outer surface of the ball. The pie-shaped indentations also create considerable turbulence as the ball is being thrown through the air, and this creates an unpredictable and unique trajectory whenever the ball is thrown. This trajectory may be varied, depending upon the amount of spin imparted to the ball. The indentations also facilitate gripping of the ball during throwing so as to impart the desired spin thereto. Because the indentations extend inwardly from the outer surface of body member 10, they also permit body member 10 to be used on a flat rough surface such as grass, and permit the grass to extend inwardly into the pie-shaped indentations so that it does not interfere with the settling of the body member on one of its flat surfaces.

The body member shown in FIG. 4 can produce a plurality of different actions both when being rolled on a flat surface and when being thrown, depending upon the pressure to which it is inflated. The pie-shaped indentations add to the flexibility of the shell of body member 28 so as to permit it to be inflated to varying degrees.

Thus it can be seen that the device accomplishes at least all of its stated objectives.

I claim:

1. An amusement device comprising:

a body member having a substantially spherical shape with six equally-sized indentations formed thereon;

each of said indentations comprising an annular rim, tapered side walls extending inwardly from said annular rim and a flat circular surface positioned radially inwardly from said annular rim, said body member having a spherical surface between said annular rims;

a plurality of raised indicia being on said flat circular surfaces, said raised indicia having a height less than the distance between said rims and said flat circular surfaces whereby said rims prevent said indicia from interfering with rolling of said body member on a flat surface;

a dimple formed in said spherical surface, said dimple being concave and being substantially smaller than said indentations so that the statistical chances of said body coming to rest on said dimple are smaller than the chances of coming to rest on one of said indentations.

2. An amusement device according to claim 1 wherein said body member is constructed of a resilient plastic material.

3. An amusement device according to claim 2 wherein said body member is solid in construction.

4. An amusement device according to claim 2 wherein said body member is hollow, the interior thereof being filled with a gaseous fluid.

5. An amusement device according to claim 1 wherein an indicia is engraved in said spherical surface of said body member at a point diametrically opposite said dimple whereby said indicia will be upwardly exposed whenever said body member comes to rest on said dimple.

6. An amusement device according to claim 5 wherein the volume of said dimple is equal to the volume of said engraved indicia so as to balance symmetrically the weight of said body member about the center thereof.

* * * * *